US006343439B1

(12) United States Patent
Rutledge

(10) Patent No.: US 6,343,439 B1
(45) Date of Patent: Feb. 5, 2002

(54) LOAD BEARING ADJUSTABLE ROOF CURB AND METHOD OF USE

(75) Inventor: Phillip R. Rutledge, Farmers Branch, TX (US)

(73) Assignee: Roδftop Systems, Inc., Carrollton, TX (US)

( * ) Notice: Subject to any disclaimer, the term of this patent is extended or adjusted under 35 U.S.C. 154(b) by 0 days.

(21) Appl. No.: 09/488,952

(22) Filed: Jan. 21, 2000

(51) Int. Cl.[7] ..... E04F 19/00

(52) U.S. Cl. ..... 52/27; 52/58; 52/60; 52/72; 52/126.1; 52/200; 248/148; 248/237; 248/678

(58) Field of Search ..... 52/27, 72, 200, 52/126.1, 126.2, 126.3, 640, 645, 58, 60, 64, 198, 219; 16/380, 386; 248/178, 149, 237, 678; 403/52, 65, 78, 408.1; 411/399

(56) References Cited

U.S. PATENT DOCUMENTS 3,742,659 A * 7/1973 Drew
4,144,681 A * 3/1979 Leffler ..... 52/127
4,202,243 A * 5/1980 Leonhardt ..... 411/501
4,526,091 A * 7/1985 Sharp
4,895,066 A * 1/1990 Carnahan
4,917,345 A * 4/1990 Czech
5,148,647 A * 9/1992 Rutledge ..... 52/488
5,257,873 A * 11/1993 Abbat ..... 403/59
5,409,266 A * 4/1995 Baker
5,454,538 A * 10/1995 Merideth
5,570,864 A * 11/1996 Flores
5,687,514 A * 11/1997 Gillispie ..... 52/58
5,791,092 A * 8/1998 Strieter
6,047,513 A * 4/2000 Gibson ..... 52/646

OTHER PUBLICATIONS

MicroMetl Corporation, *Adjustable Pitch Curbs,* Mar. 1999, 10–pages.

* cited by examiner

*Primary Examiner*—Robert Canfield
(74) *Attorney, Agent, or Firm*—Jenkens & Gilchrist, a Professional Corporation

(57) ABSTRACT

A method and an adjustable roof curb are provided that enables the mounting of an appliance onto a roof of a building. More specifically, the adjustable pitch roof curb includes a base curb section, a support curb section and at least one pin operating as a fulcrum to adjustably position the support curb section to a desired pitch relative to a pitch of the base curb section, and further operating to effectively bear a load of the appliance (e.g., fan, air conditioner) mounted on the support curb section.

5 Claims, 9 Drawing Sheets

LOAD BEARING ADJUSTABLE ROOF CURB AND METHOD OF USE

BACKGROUND OF THE INVENTION

1. Technical Field of the Invention

The present invention relates in general to a curb that is mounted on a roof of a building and is used to support air moving equipment such as an air conditioner or any other type of rooftop appliance.

2. Description of Background and Related Art

It is well known that roof curbs are used as a mounting structure for air moving equipment and other types of rooftop appliances which are located on a roof of a building. Traditionally, roof curbs where specifically designed and custom made to provide a relatively horizontal mounting structure for a particular rooftop appliance given the shape and pitch of a particular roof. Of course, designing and building these traditional roof curbs which were often one piece of metal that was custom fabricated to the particular roof pitch was a laborious and time consuming task for the manufacturers and installers of the rooftop appliances. Thus, adjustable roof curbs were developed to mount rooftop appliances on various types of roofs that have different pitches without custom making one piece roof curbs for each type of pitched roof. Two examples of known adjustable roof curbs are briefly described below with respect to FIGS. 1 and 2.

Referring to FIG. 1, there is illustrated a known adjustable roof curb 100 similar to one currently manufactured by MicroMetl Corporation. Generally, the adjustable roof curb 100 includes a bottom section 102 secured to a roof 104 and a top section 106 used to mount a rooftop appliance 108. The top section 106 is designed to slide over the bottom section 102 in a manner such that the top section can be positioned to provide a relatively level support (e.g., horizontal support) for mounting the rooftop appliance 108. After leveling the top section 106, the bottom section 102 is secured to the top section by inserting screws into pre-punched holes 110 (ten shown) that are positioned around the lower portion of the top section 106. This type of adjustable roof curb 100 can be a safety hazard because the screws are susceptible to failure due to the load (e.g., shearing load) of the rooftop appliance 108. Failure of the screws can be accelerated due to weather degradation and vibration of the roof top appliance.

Referring to FIG. 2, there is illustrated another known adjustable roof curb 200 similar to one described in U.S. Pat. No. 4,917,345. Generally, the adjustable roof curb 200 includes a base member 202 secured to a roof 204 and a support member 206 used to mount a rooftop appliance 208. The base member 202 includes at least two slotted apertures 210 (three shown) and the support member 206 also includes at least two slotted apertures 212 (two shown) for alignment with the apertures 210 formed within the base member 202. The apertures 210 and 212 enable the adjustable coupling of the support member 206 to the base member 202 to provide a level support for mounting the rooftop appliance 208. After leveling the support member 206, the base member 202 is secured to the support member 206 by inserting fasteners 214 (e.g., threaded bolts) into the aligned slotted apertures 210 and 212. To further secure the base member 202 to the support member 206, screws can be inserted into the base member 202 by passing them through apertures 216 (eleven shown) positioned around the lower portion of the support member 206. This adjustable roof curb 200 can also be a safety hazard because the threaded bolts 214 can loosen (e.g., due to vibration of the rooftop appliance 208 ) and slide-down the apertures 210 and 212. Without the load bearing capacity of bolts 214, the screws in aperture 216 now bear the load of the rooftop appliance 208. The screws in apertures 216 may then fail due to shear loading. Failure may be accelerated by weather degradation and vibration of the rooftop appliance. Thus, there is a need for an adjustable roof curb and method of use that addresses the safety hazards and other problems associated with traditional adjustable roof curbs.

BRIEF DESCRIPTION OF THE INVENTION

The present invention is a method and an adjustable roof curb that addresses the deficiencies of the prior art by safely supporting a rooftop appliance. Additionally, the present invention can be quickly assembled on the job site, saving time and installation costs over customized roof curbs or known prior art adjustable roof curbs. More specifically, the adjustable roof curb includes a base curb section, a support curb section and at least one pin operating as a fulcrum to adjustably position the support curb section to a desired pitch relative to a pitch of the base curb section, and further operating to effectively bear a load of the rooftop appliance (e.g., fan, air conditioner) mounted on the support curb section.

BRIEF DESCRIPTION OF THE DRAWINGS

A more complete understanding of the method and adjustable roof curb of the present invention may be had by reference to the following detailed description when taken in conjunction with the accompanying drawings wherein.

DETAILED DESCRIPTION OF THE DRAWINGS

Figure 1:
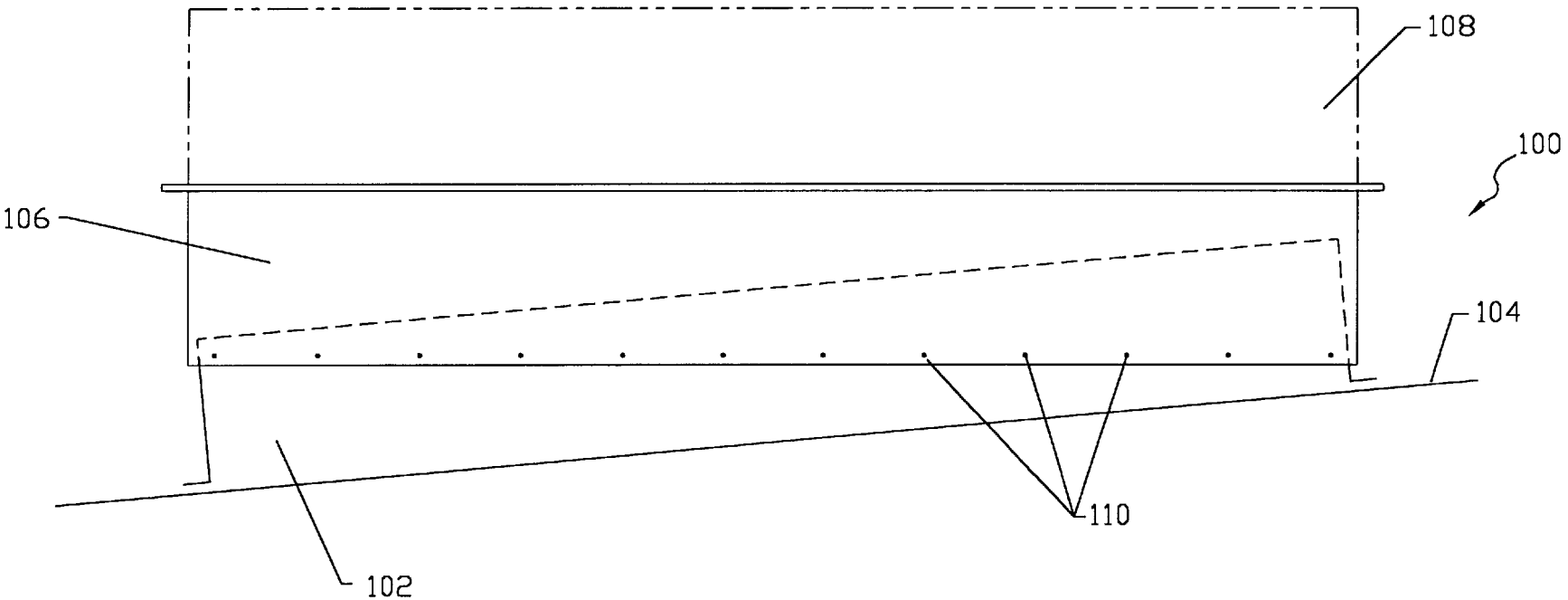
FIG. 1 ( PRIOR ART )
FIG. 1, prior art, is a side view of a known adjustable roof curb similar to one currently manufactured by MicroMetl Corporation.
Figure 2:
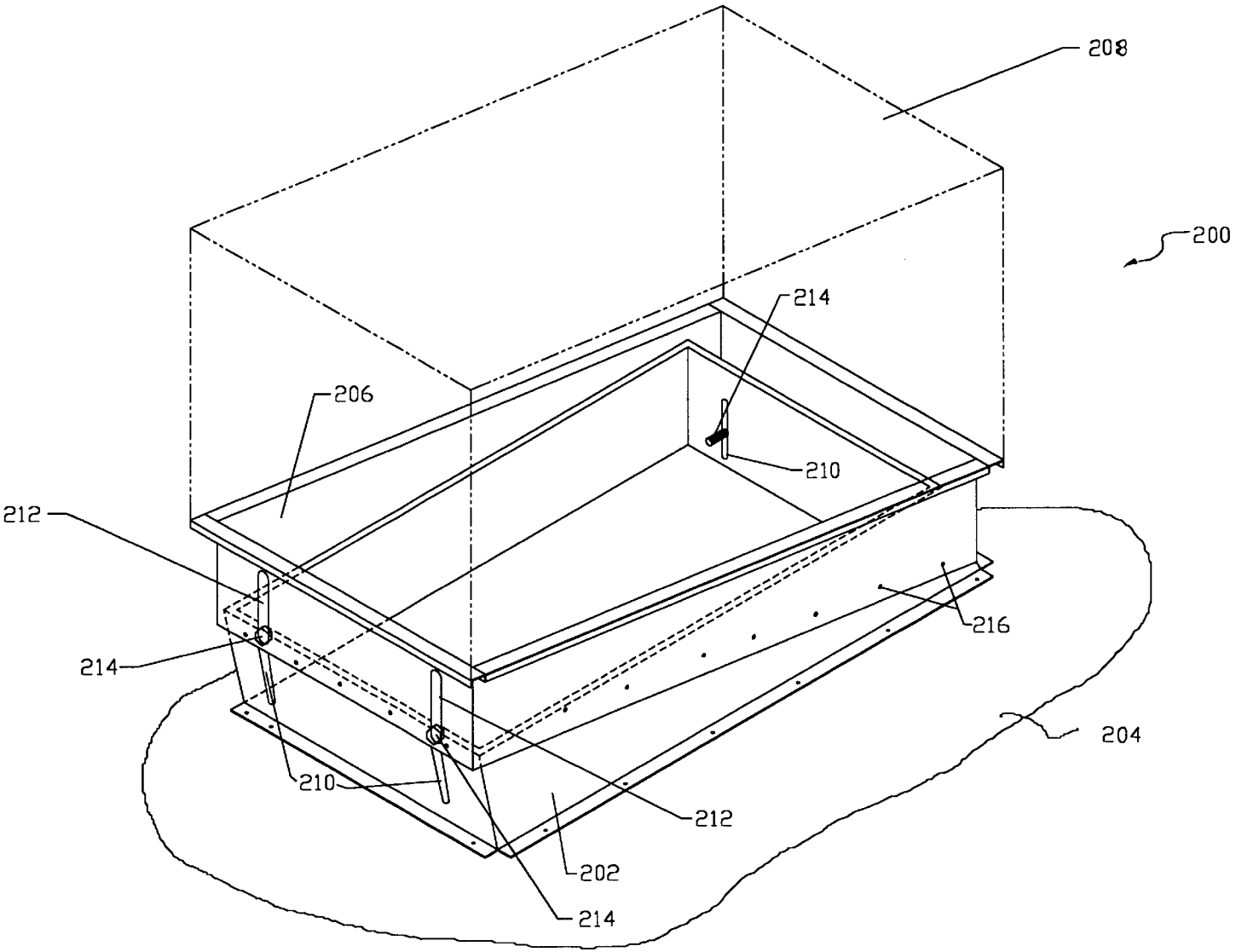
FIG. 2 ( PRIOR ART )
FIG. 2, prior art, is a perspective view of another known adjustable roof curb similar to one disclosed in U.S. Pat. No. 4,917,345.

Referring to the Drawings, wherein like numerals represent like parts throughout FIGS. 3–8, there are disclosed exemplary adjustable roof curbs 300*a* and 300*b* and a preferred method 800 in accordance with the present invention.

Although the adjustable roof curbs 300*a* and 300*b* are described with respect to supporting and mounting a rooftop appliance to a roof of a building, it should be understood that the adjustable roof curbs can be mounted on a variety of surfaces. Accordingly, the adjustable roof curbs 300*a* and 300*b* and the preferred method 800 described should not be construed in a limited manner.

Figure 3A:
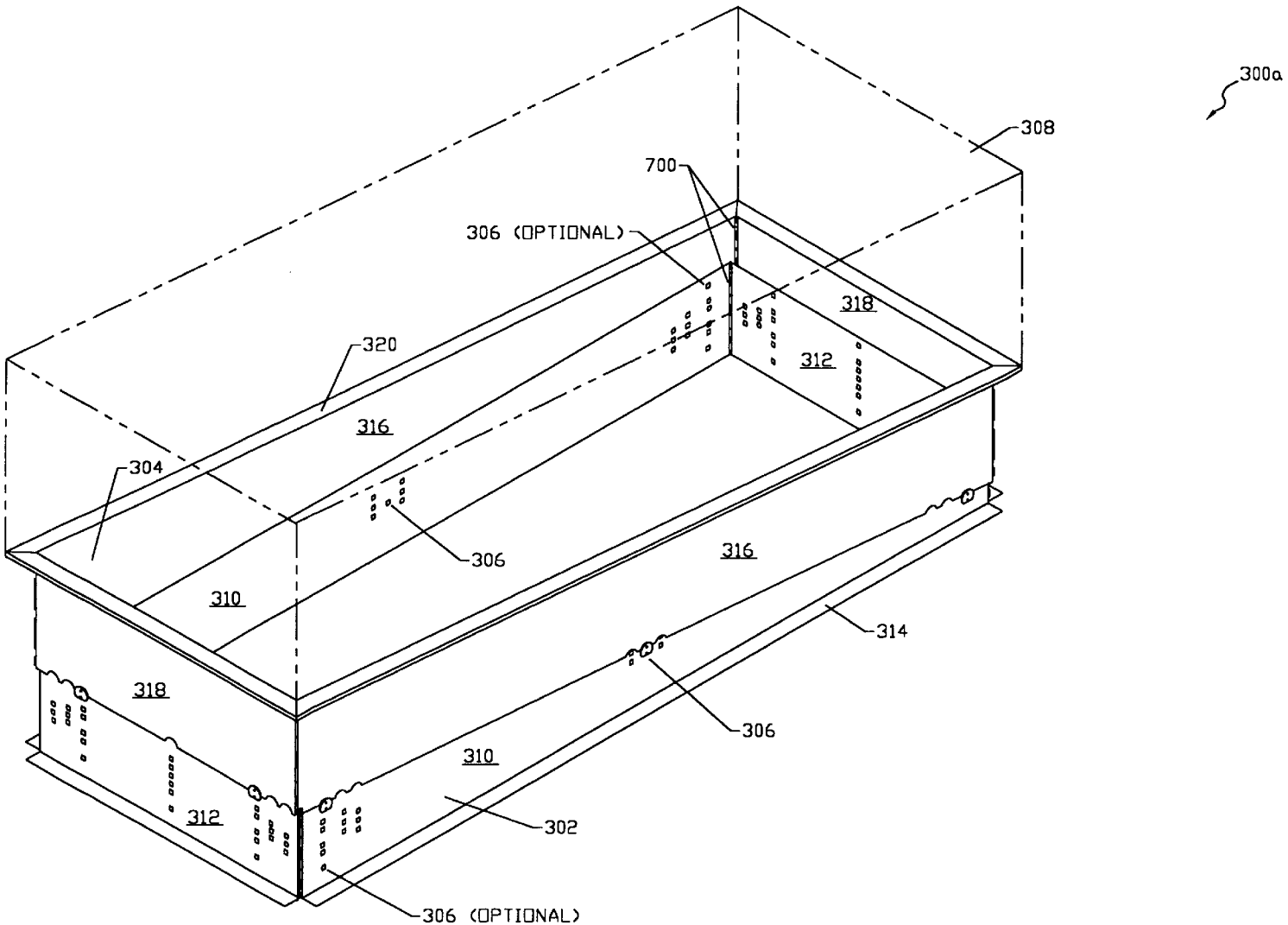
FIGS. 3*a*–3*b* are perspective views respectively illustrating the basic components of an adjustable "long side" roof curb and an adjustable "short side" roof curb in accordance with the present invention.
Figure 3B:
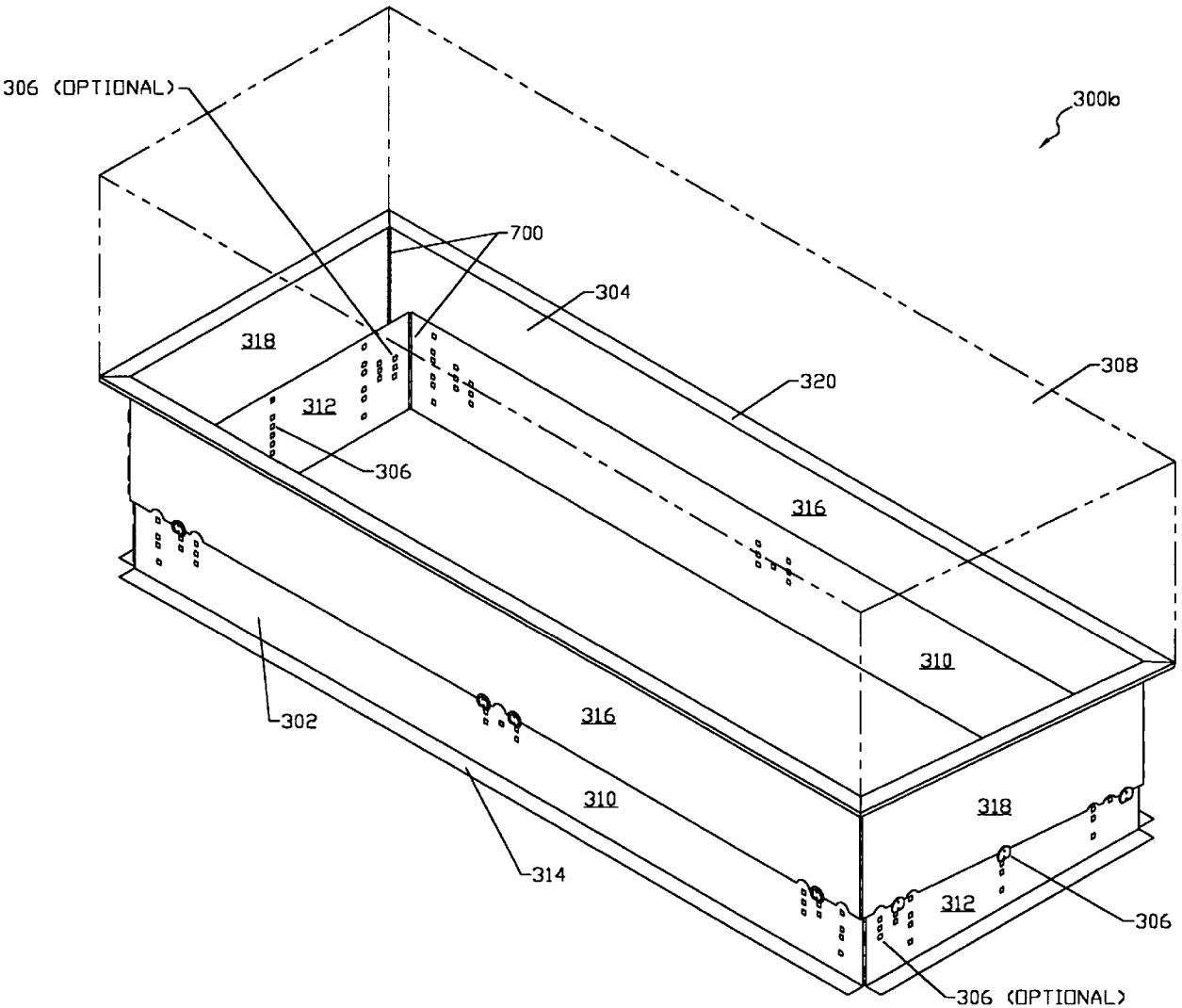

Referring to FIGS. 3*a*–3*b*, there are illustrated perspective views of the basic components of an adjustable "long side" roof curb 300 a (FIG. 3*a*) and an adjustable "short side" roof curb 300*b* (FIG. 3*b*) in accordance with the present invention. Basically, the adjustable roof curbs 300*a* and 300*b* each include a base curb section 302 and a support curb section 304 and at least one pin 306. The pins 306 (including at least a pair of pins located at the opposite sides of the adjustable roof curb) are operable to function as a fulcrum to adjustably position the support curb section 304 to a desired pitch relative to a pitch of the base curb section 302, and further operable to effectively bear a load of a rooftop appliance 308 mounted on the support curb section 304. It should be understood that the adjustable roof curb 300 is preferably manufactured such that the pitch of support curb section 304 can be adjusted on the "long side" and/or the "short side" of the adjustable roof curb. As such, the adjustable "long side" roof curb 300*a* and the adjustable "short side" roof curb 300*b* could be one adjustable roof curb.

The base curb section 302 preferably comprises a thin-walled rectangular frame (or square frame) that is hollow and open at a top side and a bottom side. The base curb section 302 is defined by a pair of long sides 310 and a pair of short sides 312 that can be secured together at their ends by a fastener, weld or hinge assembly 700 (see FIGS. 7*a*–7*b*). In addition, the base curb section 302 may include a flange 314 extending from the bottom side which is used to secure the base curb section 302 to a roof of a building. Alternatively, the base curb section 302 can be secured to the roof of the building without the flange 314.

Like the base curb section 302, the support curb section 304 preferably has a form of a thin-walled rectangular frame (or square frame) that is hollow and open at a top side and a bottom side. The support curb section 304 is defined by a pair of long sides 316 and a pair of short sides 318 that can be secured together at their ends by a fastener, weld or hinge assembly 700 (see FIGS. 7*a*–7*b*). In addition, the support curb section 304 may include a flange 320 extending from the top side of the support curb section to mount the rooftop appliance 308. Alternatively, the support curb section 304 may include support struts (not shown) extending across the top side of the support curb section to mount the rooftop appliance 308. Such struts are illustrated in U.S. Pat. No. 5,148,647 assigned to the assignee of this application, the disclosure of which is incorporated by reference. Moreover, the support curb section 304 is manufactured to be slightly larger than the base curb section 302 so that it can fit over at least a portion of the base curb section 302 and be adjustable relative to the base curb section as described in greater detail below.

Figure 4B:
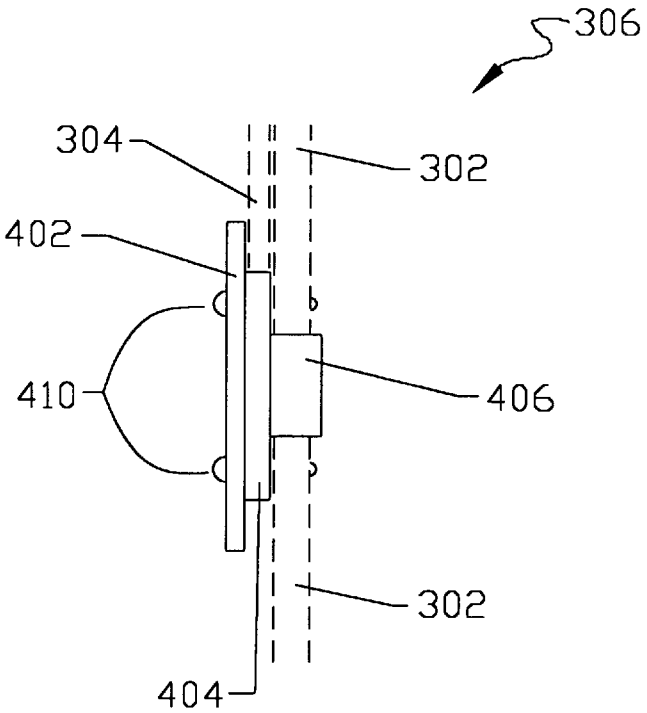
FIGS. 4*a* and 4*b* respectively illustrate a perspective view of a pin and a side view of one of the pins used to adjustably couple a support curb section and a base curb section of the adjustable roof curbs shown in FIGS. 3*a* and 3*b;*
Figure 4A:
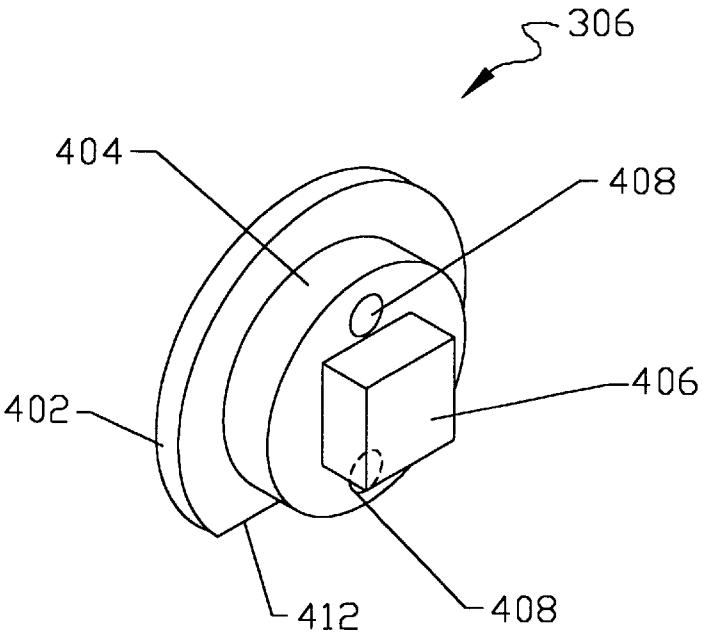

Referring to FIGS. 4*a* and 4*b*, there are respectively illustrated a perspective view of one of the pins 306 and a side view of one of the pins 306. Basically, each pin 306 is configured to function as a fulcrum to adjustably position the support curb section 304 to a desired pitch relative to a pitch of the base curb section 302, and is also configured to bear the weight of the rooftop appliance 308. Each pin 306 preferably includes a support face 402 that is adjacent to a portion of the support curb section 304, an arc 404 that engages a mating semicircular notch 502 in the lower portion of the support curb section 304 and a shaft 406 that fixably engages the base curb section 302. In the disclosed embodiment the shaft has a square configuration which is received in any of the square openings 506, 504, 514, 604, 606 and 614 of base curb section 302 (see FIGS. 5–6). Such configuration prevents pin 306 from rotating in base curb 302. It will be understood by those skilled in the art that other geometric configurations can be employed in the practice of the subject invention. When the present invention is assembled, semicircular notch 502 or 602 in support curb 304 rotatably engages the arc 404 of fixed pin 306 fixably positioned in base curb 302 (see FIG. 5). Each pin 306 may further include at least one hole 408 (two shown) that enables a fastener 410 to secure the support curb section 304 between the support face 402 and the base curb section 302. It should be understood that the illustrated configuration of the pin 306 is exemplary and that many other configurations can be used to design a pin that functions in the same manner as pin 306. It will be understood by those skilled in the art that pin 306 may have a round configuration for shaft 406 which would be received in round openings within the base curb section 302. Instead of an arc 404 in pin 306, the section 404 may have any number of polygonal configurations which would have a corresponding mating polygonal configuration in notch 502 or 602. In such an embodiment, when the invention is assembled notch 502 or 602 would engage polygonal configuration 402 of pin 306 and shaft 406 would rotate in openings 504, 506, 514, 604, 614 and 616.

Figure 5:
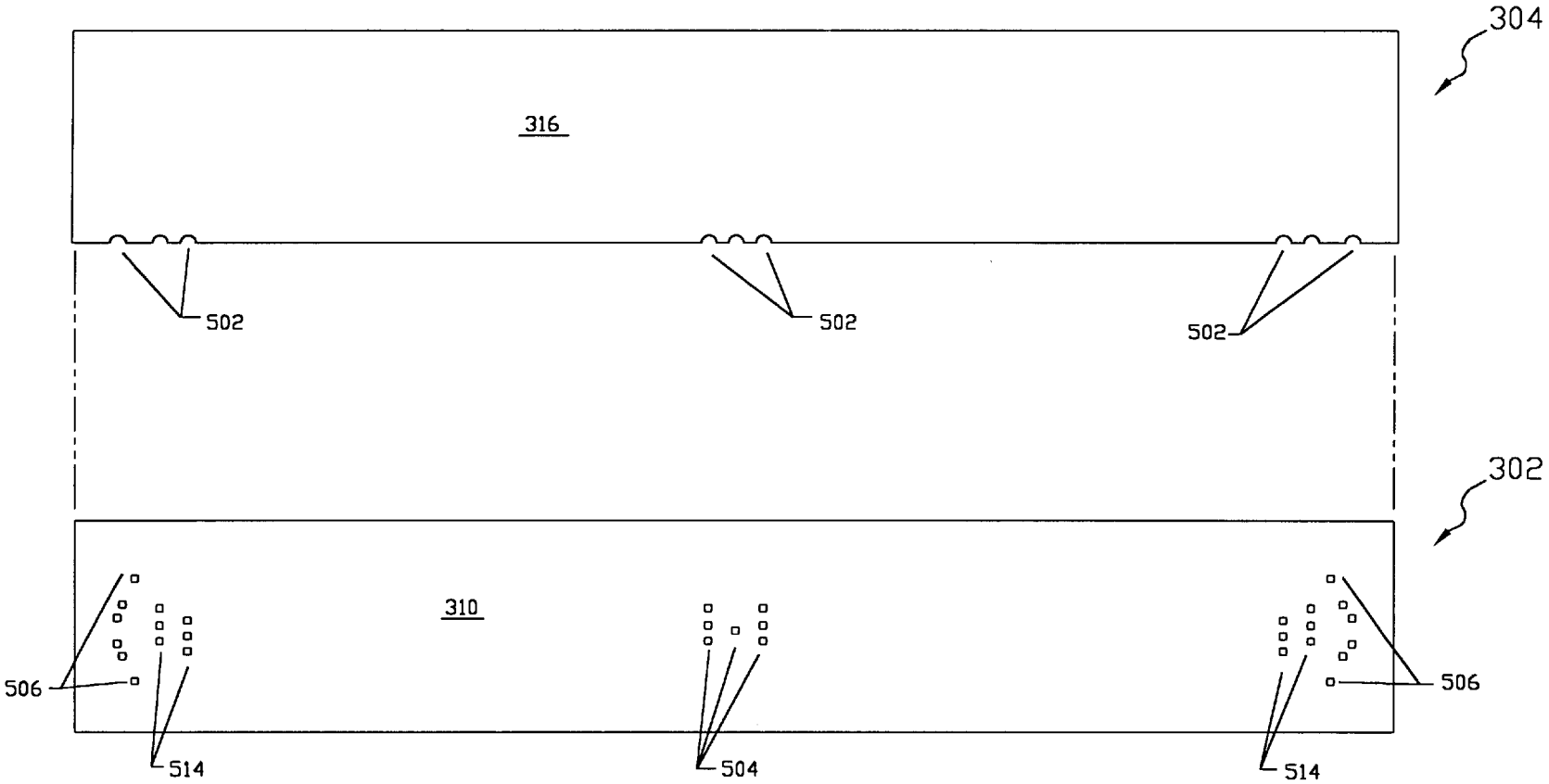
FIG. 5 illustrates in greater detail the support curb section and the base curb section of the adjustable "long side" roof curb shown in FIG. 3*a;*

Referring to FIG. 5, there are illustrated side views of one long side 316 of the support curb section 304 and one long side 310 of the base curb section 302 which are adjustably coupled to one another using one or more pins 306 to form the adjustable "long side" roof curb 300 a shown in FIG. 3*a*. The support curb section 304 preferably includes at least one notch 502 (nine shown) within the bottom side of each long side 316 (one shown) that rotatably engages the arc 404 of the pin 306 (see FIG. 4*b*).

The base curb section 302 preferably includes at least one slot 504 (seven shown) within each long side 310 (one shown) that fixably engages the shaft 406 of the pin 306 (see FIG. 4*b*). In addition, the base curb section 302 can also include at least one series of holes 506 (two shown) of which one hole 508 can be used to engage a fastener to further bear the load of the rooftop appliance (not shown). The fastener can include any type of fastener including a bolt or another pin 306. Each series of holes 506 are positioned in a manner to form a predetermined arc that directly relates to a series of desirable pitches that the support curb section 304 can be secured to the base curb section 302. For instance, the holes 506 can be positioned in predetermined locations so as to adjust the support curb section 304 to match various roof pitches, including but not limited to ¼ inch, ½ inch or 1 inch rise to 12 inch run. After leveling and pining the support curb section 304 to the base curb section 302, the base curb section 302 and the support curb section 304 can be further secured to one another by using traditional fasteners such as self-tapping screws. These traditional fasteners also help to create a weathertight seal between the base curb section 302 and the support curb section 304.

Referring again to FIG. 3*a*, the pin 306 is illustrated as being positioned near the middle of the long sides 310 and 316 of the base curb section 302 and the support curb section 304. However, alternatively the pin 306 may instead be located within one of the holes 506 to maximize the capability of the pin 306 to adjustably position the support curb section 304 to the desired pitch (see optional position in FIG. 3*a*). For instance, the support curb section 304 may obtain a greater pitch relative to the base curb section 302 when the pin 306 is located near one of the corners of the long sides 310 and 316 as opposed to being located near the middle of the long sides 310 and 316. The support face 402 of the pin 306 may have a flat side 412 that enables the pin 306 to be located near a bottom side of the base curb section 302 (see FIG. 4*a*).

Moreover, the long side 310 of the base curb section 302 can include another set of holes 514 (twelve shown) several of which can be used in conjunction with a fastener (not shown) to further secure the base curb section 302 to the support curb section 304 when the adjustable roof curb is an adjustable "short side" roof curb 300*b* as described below with respect to FIG. 6. In other words, the holes 514 are not used or needed when the adjustable roof curb is just an adjustable "long side" roof curb 300*a*.

Figure 6:
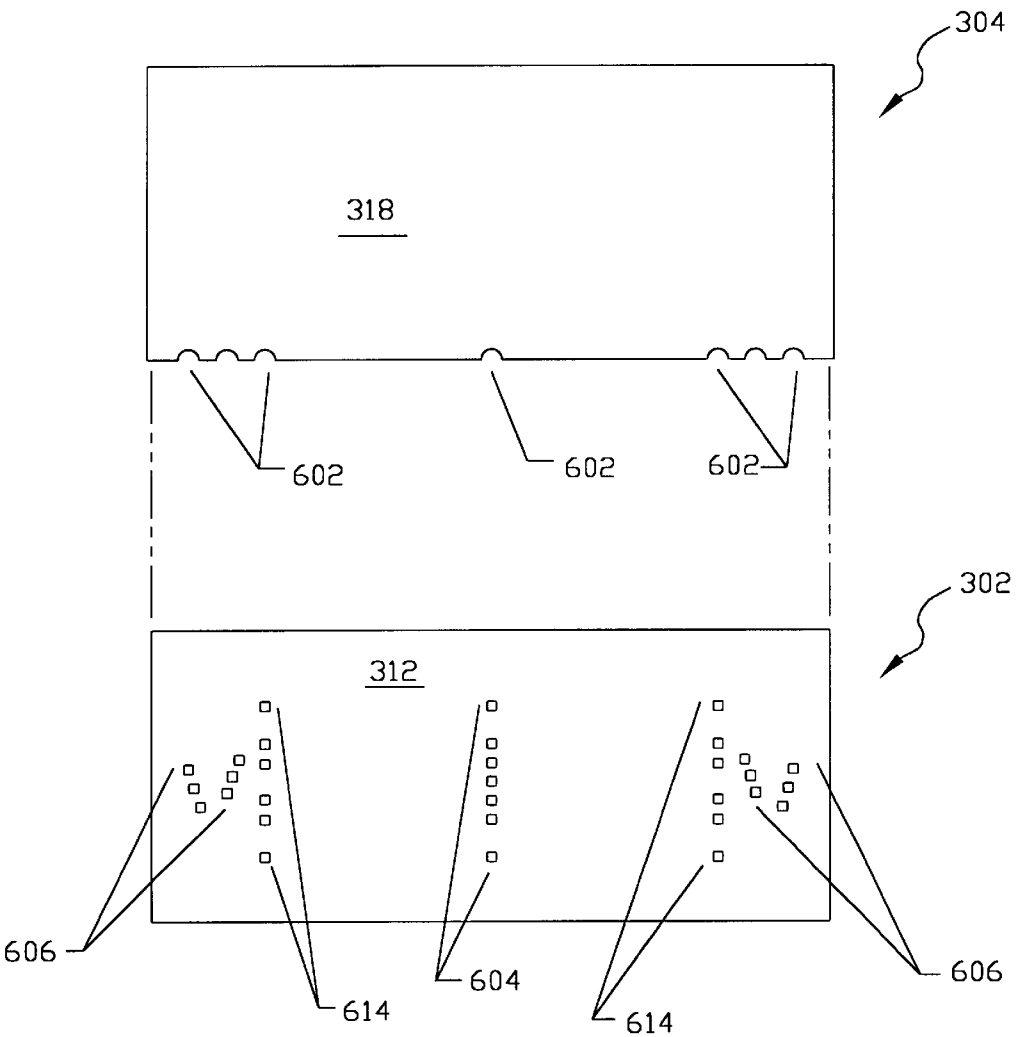
FIG. 6 illustrates in greater detail the support curb section and the base curb section of the adjustable "short side" roof curb shown in FIG. 3*b;*

Referring to FIG. 6, there are illustrated side views of one short side 318 of the support curb section 304 and one short side 312 of the base curb section 302 which may be adjustably coupled to one another using one or more pins 306 to form the adjustable "short side" roof curb 300*b* shown in FIG. 3*b*. The support curb section 304 preferably includes at least one notch 602 (seven shown) within the bottom side of each short side 318 (one shown) that rotatably engages the arc 404 of the pin 306 (see FIG. 4*b*).

The base curb section 302 preferably includes at least one slot 604 (seven shown) within each short side 312 (one shown) that fixably engages the shaft 406 of the pin 306 (see FIG. 4*b*). In addition, the base curb section 302 can also include at least one series of holes 606 (one series of holes 606 is located at each end of the short side 312) of which one hole can be used to engage a fastener to further bear the load of the rooftop appliance (not shown). The fastener can include any type of fastener including a bolt or another pin 306. Each series of holes 606 are positioned in a manner to form a predetermined pattern (arrangement) that directly relates to a series of desirable pitches that the support curb section 304 can be secured to the base curb section 302. For instance, the holes 606 can be positioned in predetermined locations so as to adjust the support curb section 304 to match common roof pitches, including but not limited to ¼inch, ½inch or 1 inch rise to 12 inch run. Moreover, the holes 606 may be positioned in a predetermined arc similar to the predetermined arc of the holes 505 of FIG. 5 and vice-versa. After leveling and pining the support curb section 304 to the base curb section 302, the base curb section 302 and the support curb section 304 can be further secured to one another by using traditional self-tapping screws. Again, these traditional fasteners also help to create a weathertight seal between the base curb section 302 and the support curb section 304.

It will be appreciated by those skilled in the art, as heretofore discussed, that pin 306 may have various geometric configurations and the openings in curb 302 and curb 304 may have mating configurations.

Referring again to FIG. 3*b*, the pin 306 is positioned near the middle of the short sides 312 and 318 of the base curb section 302 and the support curb section 304. However, the pin 306 may instead be located within one of the holes 606 to maximize the capability of the pin 306 to adjustably position the support curb section 304 to the desired pitch (see optional position in FIG. 3*b*). For instance, the support curb section 304 may obtain a greater pitch relative to the base curb section 302 when the pin 306 is located near one of the corners of the short sides 312 and 318 as opposed to being located near the middle of the short sides 312 and 318.

Again, the support face 402 of the pin 306 may have a flat side 412 that enables the pin 306 to be located near a bottom side of the base curb section 302 (see FIG. 4*a*).

Moreover, the short side 318 of the base curb section 302 also includes another set of holes 614 (twelve shown) several of which can be used in conjunction with a fastener (not shown) to further secure the base curb section 302 to the support curb section 304 when the adjustable roof curb is an adjustable "long side" roof curb 300*a* as described above with respect to FIG. 5. In other words, the holes 614 are not used or needed when the adjustable roof curb is just an adjustable "short side" roof curb 300*b*.

Again, it should be understood that the adjustable roof curb 300 of the present invention can be manufactured to be adjustable on the "long side" and/or "short side" depending on the need of the installer (see FIGS. 3*a*–3*b*). For instance, the adjustable roof curb 300 can be manufactured to include the long sides 310 and 316 and the short sides 312 and 318 shown in FIGS. 5–6. It will be appreciated by those skilled in the art that the present invention may also be used in connection with compound pitch roofs, wherein adjustments are made in both "long side" and "short side" directions at the same time.

Figure 7A:
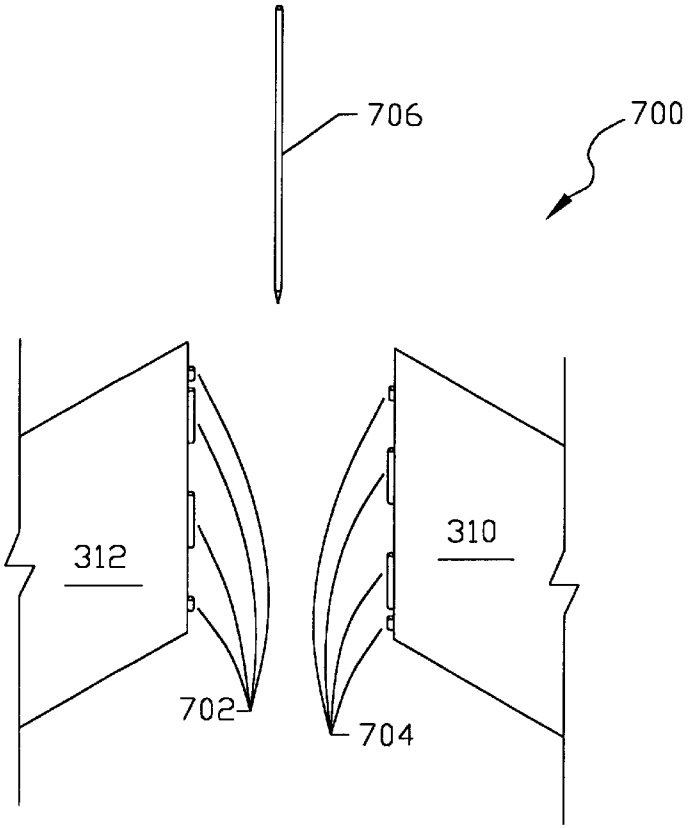
FIGS. 7*a*–7*b* respectively illustrate a disassembled an assembled fragmentary view in perspective of a corner of the base curb section or the support curb section shown in FIGS. 3 and 5–6.
Figure 7B:
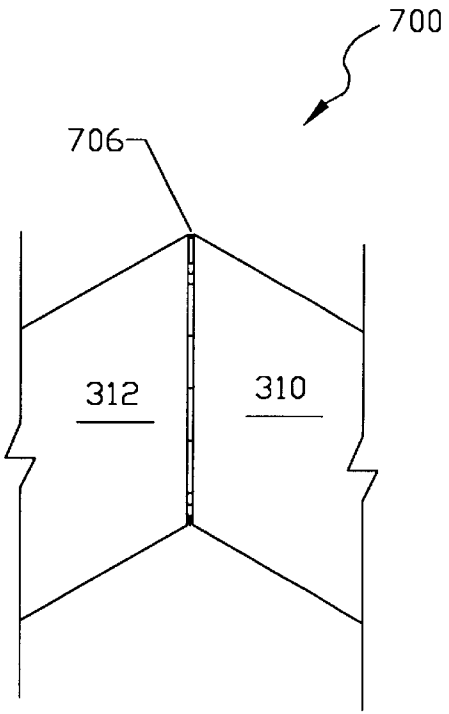

Referring to FIGS. 7*a* and 7*b*, there are respectively illustrated disassembled and assembled fragmentary views in perspective of the preferred hinge assembly 700 that can be used to connect each end of the base curb section 302 and/or the support curb section 304. The hinge assembly 700 includes a set of hinge ears 702 (four shown) formed in each end of the short sides 312 and 318 (short side 312 shown). In addition, the hinge assembly includes another set of hinge ears 704 (four shown) formed in each end of the long sides 310 and 316 (long side 310 shown). The hinge ears 702 and 704 are coupled to one another such that a hinge pin 706 can be inserted therein to secure the long sides 310 and 316 to the short sides 312 and 318, respectively. As illustrated, one short side 312 and one long side 310 of the base curb section 302 are coupled together using one hinge assembly 700.

The hinge assembly illustrated and described above has been disclosed in U.S. Pat. No. 5,148,647 that was assigned to the same assignee as in the present application. As such, the hinge assembly disclosed in U.S. Pat. No. 5,148,647 is hereby incorporated into the specification of the present application.

Figure 8:
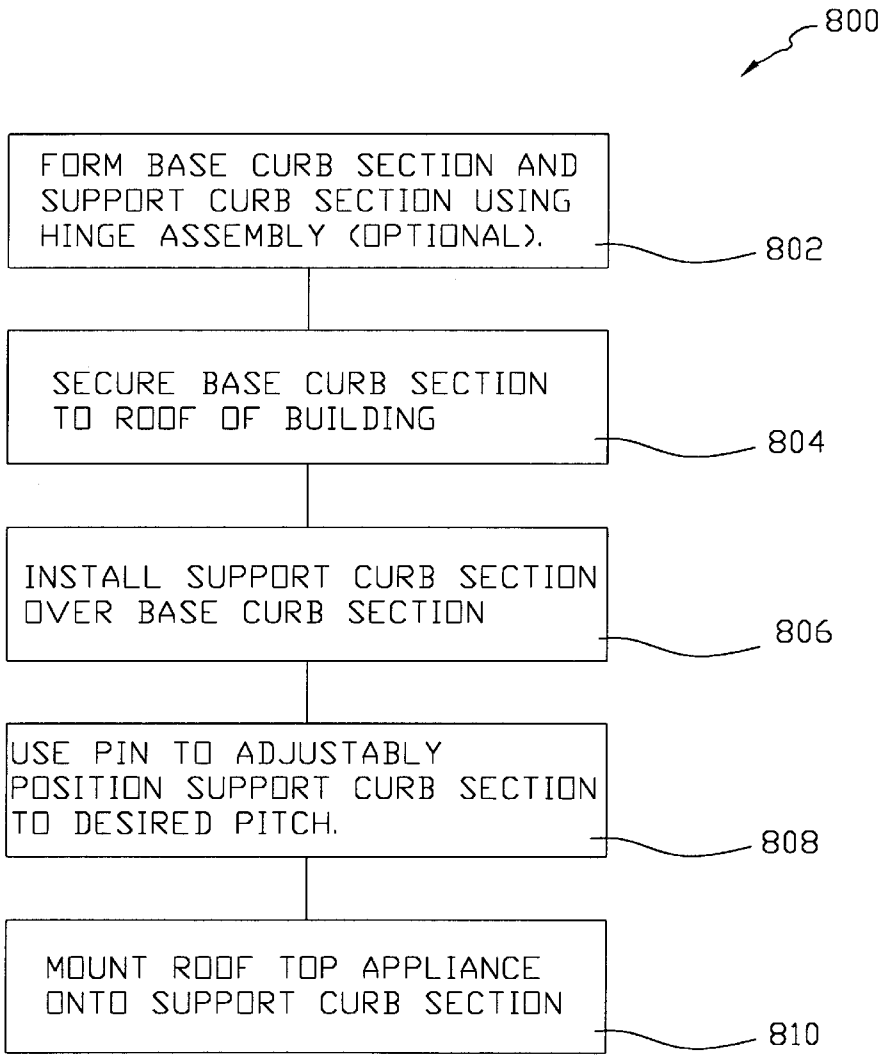
FIG. 8 is a simplified flowchart illustrating the basic steps of the preferred method of the present invention.

Referring to FIG. 8, there is a simplified flowchart illustrating the basic steps of the preferred method 800 for mounting a rooftop appliance on a roof of a building in accordance with the present invention. Beginning at step 802 (optional), each pair of curb sides 310, 312, 316 and 318 are rotatably coupled to one another using hinge assemblies 700 to form the base curb section 302 and the support curb section 304. At step 804, the base curb section 302 is secured to the roof of the building. At step 806, the support curb section 304 is installed over at least a portion of the base curb section 302. Thereafter, at step 806, an installer uses at least one pin 316 on opposite sides of base curb 302 as a fulcrum to adjustably position the support curb section 304 to a desired pitch relative to a pitch of the base curb section 302. More specifically, the installer can use the at least one pin 306 on appropriate sides such that the arc 404 portion of pins 306 rotatably engage the notch 502 in support section curb 304 and the shaft 406 fixably engages the base curb section 302 to adjustably position the support curb section 304. At step 806, the installer can insert another pin 306 (or alternatively a conventional fastener such as a threaded bolt within one of the holes 506 or 606 that are arranged in the form of a predetermined arc in the base curb section 302 to provide further support to bear the load of the rooftop appliance. The installer can also insert another pin 306 (or alternative fastener) into one of the holes 514 or 614 of the base curb section 302 depending on whether a "long side" or "short side" of the adjustable roof curb 300 is being adjusted. Lastly, at step 810, the rooftop appliance is mounted onto the support curb section 304.

From the foregoing, it can be readily appreciated by those skilled in the art that the present invention provides a method and adjustable roof curb that addresses the deficiencies of the prior art by easily adjusting the pitch of the support curb relative to the pitch of the base curb and safely distributing the load of a mounted rooftop appliance. Further advantages over prior art include assembly by two persons in substantially less time than that required by multiple personnel normally used to assemble the prior art adjustable mounting curbs.

Although several embodiments of the adjustable roof curb and method of the present invention has been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following.

What is claimed is:

1. A roof mounting curb comprising:

a base curb section;

a support curb section; and at least one pin slidably inserted into one of a plurality of predetermined aperatures in the base curb section, the pin having a shaft to fixably engage said base curb section and an arc to rotatably engage said support curb section and operate to effectively bear a load of an appliance mounted on said support curb section, and further operating as a fulcrum to adjustably position said support curb section to a desired pitch relative to said base curb section; and wherein said support curb section includes at least one notch to rotatably engage the arc of said at least one pin, and said base curb section includes at least one predetermined aperture configured to receive and fixably engage the shaft of said at least one pin.

2. The roof mounting curb of claim 1, wherein said base curb section further includes a plurality of holes arranged in a predetermined arrangement such that at least one hole can be used to fixably engage another pin to further bear the load of the appliance mounted on said support curb section.

3. The roof mounting curb of claim 2, wherein the predetermined arrangement of the plurality of holes relates to a plurality of pitches including the desirable pitch that said support curb section can be secured to said base curb section.

4. A roof mounting curb comprising:

a base curb section;

a support curb section;

at least one pin slidably inserted into one of a plurality of predetermined apertures in the base curb section operating to effectively bear a load of an appliance mounted on said support curb section, and further operating as a fulcrum to adjustably position said support curb section to a desired pitch relative to said base curb section; and wherein said support curb includes a semicircular notch for rotatably engaging an arc portion of the at least one pin to adjustably position said support curb section to the desired pitch.

5. An adjustable roof curb for mounting an appliance on a roof of a building, said adjustable pitch curb comprising:

a base curb section being secured to the roof of the building;

a support curb section being dimensionally larger than said base curb section and installed over at least a portion of said base curb section;

at least one pin slidably inserted into one of a plurality of predetermined apertures in the base curb section operating to effectively bear a load of the appliance mounted on said support curb section, and further operating as a fulcrum to adjustably position said support curb section to a desired pitch relative to a pitch of said base curb section, said at least one pin further includes an arc to rotatably engage said support curb and a shaft to fixably engage said base curb section; and wherein said support curb section includes at least one notch to rotatably engage the arc of said at least one pin, and said base curb section includes at least one predetermined aperture sized to receive and to fixably engage the shaft of said at least one pin.

* * * * *

UNITED STATES PATENT AND TRADEMARK OFFICE

CERTIFICATE OF CORRECTION

PATENT NO. : 6,343,439 B1
DATED : February 5, 2002
INVENTOR(S) : Phillip R. Rutledge It is certified that error appears in the above-identified patent and that said Letters Patent is hereby corrected as shown below:

Title page,
Item [73], Assignee, "Roδftop Systems, Inc." needs to be corrected to read as follows: -- Rooftop Systems, Inc. -- the Greek symbol needs to be replaced with the correct letter, "o"

Column 2,
Lines 50-51, Brief Description of the Drawings, FIGS. 7a-7b respectively illustrate "a disassembled an assembled" this should be corrected to read -- a disassembled and assembled" -- the "an" should be changed to the word "and."

Column 4,
Line 27, Detailed Description of the Drawings, delete the numeral "402" behind the words "polygonal configuration."

Signed and Sealed this

Eighteenth Day of June, 2002

*Attest:*

*Attesting Officer*

JAMES E. ROGAN
*Director of the United States Patent and Trademark Office*